US006637910B1

(12) United States Patent
Mehler et al.

(10) Patent No.: US 6,637,910 B1
(45) Date of Patent: Oct. 28, 2003

(54) EARPIECE LIGHT

(76) Inventors: Brian Mehler, 3806 Gaviota Ave., Long Beach, CA (US) 90807; Andrew Palmer, 72764 San Juan Dr., Palm Desert, CA (US) 92260

( * ) Notice: Subject to any disclaimer, the term of this patent is extended or adjusted under 35 U.S.C. 154(b) by 0 days.

(21) Appl. No.: 10/137,082

(22) Filed: Apr. 29, 2002

(51) Int. Cl.[7] ..... F21L 4/00

(52) U.S. Cl. ..... 362/190; 362/104; 362/198; 362/206; 362/253; 181/141

(58) Field of Search ..... 362/190, 183, 362/191, 104, 189, 198, 800, 383, 206, 200, 285, 288, 293, 295, 277, 253; 181/129, 141

(56) References Cited

U.S. PATENT DOCUMENTS 4,969,069 A 11/1990 Eichost
5,353,205 A 10/1994 Hudak
5,894,113 A 4/1999 Wingate
5,951,158 A * 9/1999 Upah ..... 362/571
5,997,165 A 12/1999 Lehrer
6,239,927 B1 5/2001 Lanzillo et al.
6,290,368 B1 9/2001 Lehrer

* cited by examiner

*Primary Examiner*—Sandra O'Shea
*Assistant Examiner*—John Anthony Ward
(74) *Attorney, Agent, or Firm*—Gordon E. Gray, III; Gray Law Firm

(57) ABSTRACT

The present invention is an improved earpiece light. In particular, the present invention is directed to an earpiece having a power supply and a light source mounted on the earpiece. The earpiece light is preferably for use on a person's outer ear. The earpiece light comprises an ear support, preferably for placement behind the user's crest of helix. The ear support is attached to a power supply housing, preferably for placement over the user's external auditory canal. The power supply housing has a power supply and a lamp arm with a distal end extended from the power supply housing. The power supply is connected to a light source mounted on the distal end of the lamp arm. Preferably, the lamp arm is positioned below the ear support and the power supply is connected to a light source, preferably an LED, mounted on the lamp arm.

19 Claims, 3 Drawing Sheets

EARPIECE LIGHT

TECHNICAL FIELD

The present invention is an improved earpiece light. In particular, the present invention is directed to an earpiece having a power supply and a light source mounted on the earpiece.

BACKGROUND ART

Generally, an earpiece light is a light mounted to a user's ear. Several head and/or ear mounted lights are known including U.S. Pat. Nos. 5,894,113, 4,969,069, 5,997,165, 5,353,205, and 6,290,368.

Several common problems can occur with prior art lights. In particular, the lights are cumbersome, have unwieldy power sources, and are difficult to position for optimum viewing use.

SUMMARY OF THE INVENTION

The present invention is an improved earpiece light. In particular, the present invention is directed to an earpiece having a power supply and a light source mounted on the earpiece. The earpiece light is preferably for use on a person's outer ear. The earpiece light comprises an ear support, preferably for placement behind the user's crest of helix. The ear support is attached to a power supply housing, preferably for placement over the user's external auditory canal. The power supply housing has a power supply and a lamp arm with a distal end extended from the power supply housing. The power supply is connected to a light source mounted on the distal end of the lamp arm. Preferably, the lamp arm is positioned below the ear support and the power supply is connected to a light source, preferably an LED, mounted on the lamp arm.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved earpiece light.

Figure 1:
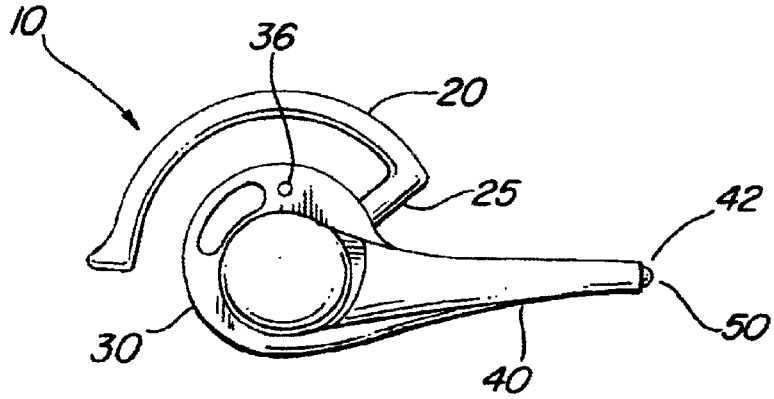
FIG. 1 is a side view of a preferred embodiment of the invention.
Figure 4:
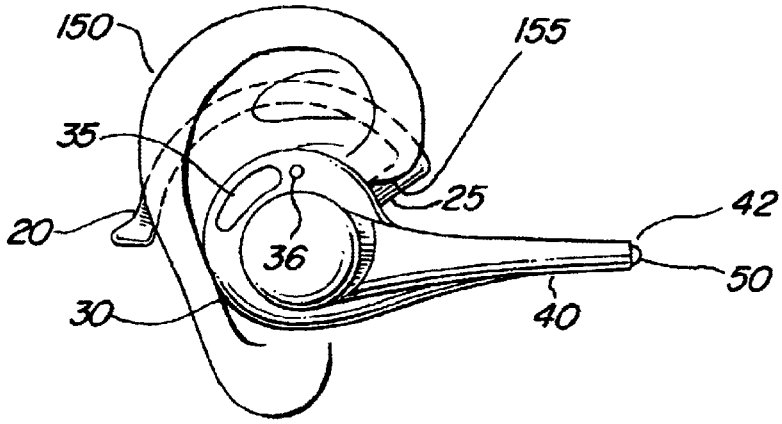
FIG. 4 is a side view of a preferred embodiment of the invention as worn on a user's ear.

Referring now to FIG. 1, a preferred embodiment of the invention 10 is shown. The invention 10 has an ear support 20. The support 20 preferably has a rounded arch extended from a radial arm 25. The ear support 20 is preferably made of a flexible, soft molded polyvinyl chloride (PVC) material. Alternately, the ear support can be made of foam rubber or hard plastic, e.g. high impact polystyrene (HIPS) and/or ABS. The preferred embodiment of the ear support 20 is suited for wearing by a user behind the user's crest of helix 155 of the outer ear 150 as shown in FIG. 4. The ear support 20 is preferably adjustable.

The radial arm 25 is attached to a power supply housing 30. The power supply housing 30 has a lamp arm 40 with a distal end 42. As shown in FIG. 4, the power supply housing 30, lamp arm 40 and light source 50 are positioned below the ear support 20 and arranged to cover a user's external auditory canal.

Figure 6:
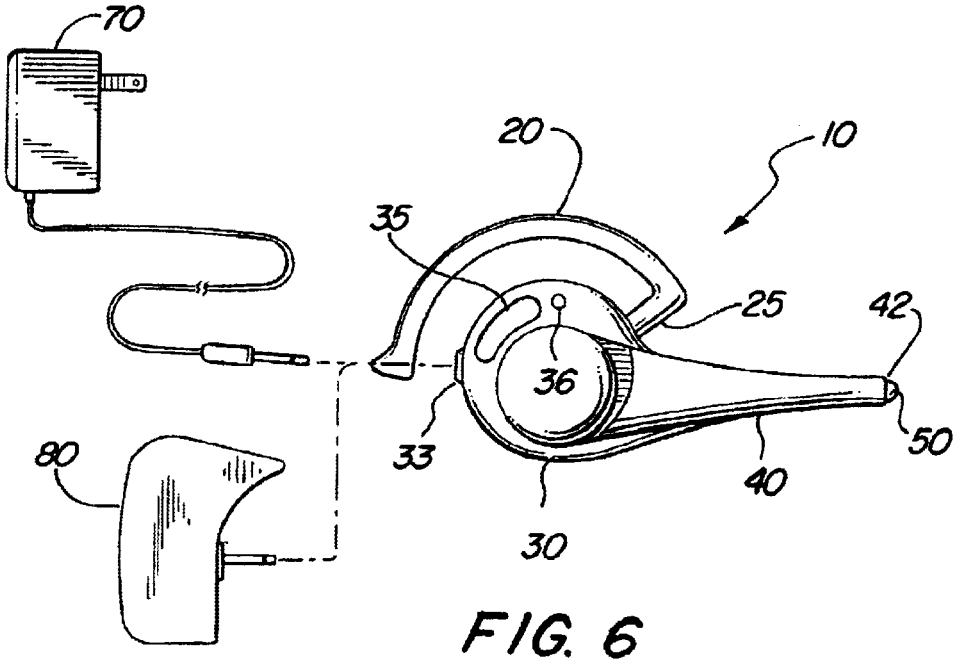
FIG. 6 is a side view of an alternate embodiment with an adaptor jack and two alternate power supplies.

The power supply housing 30 is preferably made of ABS. As shown in FIG. 6, the power supply housing may also have an adaptor jack 33 to receive power from an alternative power supply such as an AC source 70 or an additional battery pack 80. The adaptor jack 33 can alternatively be used to recharge batteries used as a power supply 37.

A light source 50 is preferably mounted on the distal end 42. The light source 50 can be, inter alia, a lamp, a bulb or a light emitting diode (LED). Alternately, the light source 50 can be a laser. The laser, rather than purely for illumination, can be useful as, inter alia, a pointing device or an aiming device. Additionally, a glare shield 52 can be mounted on the distal end 42 of the lamp arm 40. The glare shield 52 is used to deflect glare from a user's eyes from the light source 50. Preferably, the glare shield 52 can be pivoted around the light source 50.

Figure 2:
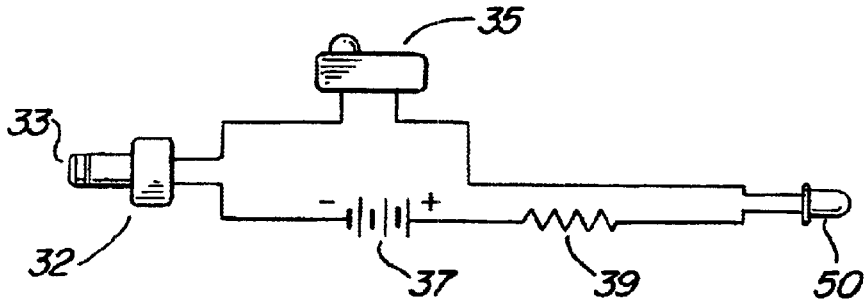
FIG. 2 is a circuit diagram for a preferred embodiment of the invention.

Referring to FIG. 2, a preferred embodiment of a circuit 32 is shown as contained within the power supply housing 30. The circuit 32 comprises a power supply 37, a resistor 39 (4 ohms preferred), a sliding power switch 35 and a light source 50. Preferably, the power supply 37 is a 6V button cell cylindrical alkaline battery, 165 mAh, by Vinnic, Model # L1325, Type 4G13. Alternately, for example, two 3-volt lithium batteries or a standard AAA battery can be used depending on desired cost and battery life. Other power supply alternatives are, e.g., fuel cells and rechargeable NiCad batteries. The circuit 32 also comprises the adaptor jack 33 used to either recharge the power supply 37 or provide an alternate power source, such as AC power from an adaptor 70 or from a battery pack 80 as shown in FIG. 6.

Figure 7:
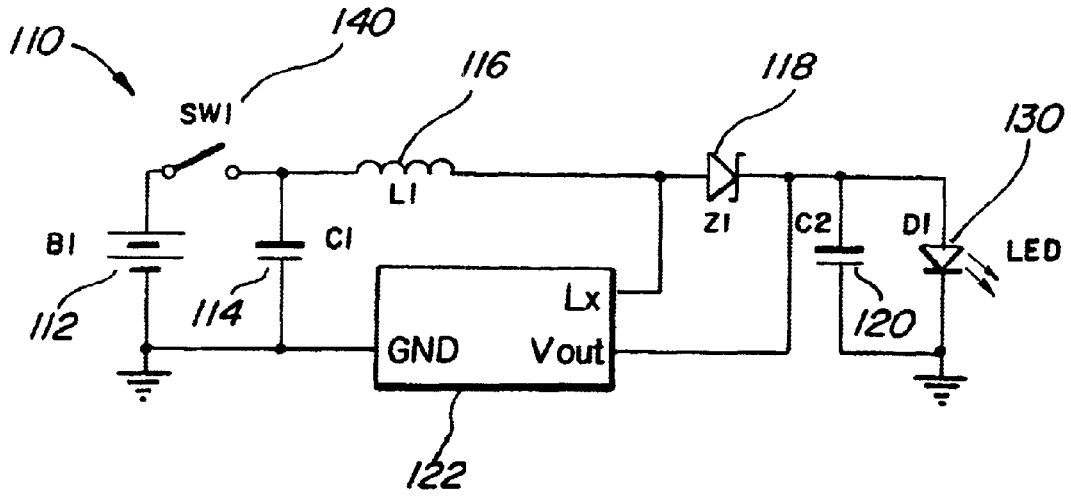
FIG. 7 is a diagram of an alternative circuit for oscillating power to an LED in an alternate preferred embodiment of the invention.

Alternatively, when the light source 50 comprises an LED, the battery life for the invention 10 can generally be increased by oscillating power on and off to the LED. A preferred embodiment of the circuit 110 for oscillating the LED 130 is shown in FIG. 7. The circuit 110 comprises a battery 112. A 1.5 V AAA cell with a capacity of 1150 mAH can usually provide approximately 20 hours of light from an LED 130 using the oscillating circuit 110 shown in FIG. 7.

The circuit 110 shown in FIG. 7 also comprises a first capacitor 114 (10 pF/10 V preferred), a first inductor 116 (100 $\mu$H preferred), a Zener diode 118, a second capacitor 120 (47 pF/16 V preferred), an oscillating element 122, and an LED 130. A switch 140, such as the sliding power switch 35 shown in FIG. 1, controls the circuit 110 shown in FIG. 7. The oscillating element 122 is preferably an integrated circuit (IC) chip that oscillates power to the LED 130.

The light source 50 is preferably an ultra-bright white LED. An example of a useful ultra-bright white LED is Part Number GB-333UWC, Spec. Number LL-503WC2R-003 from Globe Technology Components. Another preferred LED is a 3 V LED white clear super bright GaInN/SiC such as Module No. W05310WSC-03 V from Waitrony Co. Limited of China. Alternatively, the light source can consist of multiple LEDs for increased illumination. Battery life (or AC power usage), brightness and cost can each affect the choice of a light source 50 for the invention 10.

Preferably, the sliding power switch 35 is integrated with the housing 30 as best shown in FIG. 1. Alternately, the power switch 35 can be a button, a rocker switch, or a lever switch. The power switch 35 can also act as a dimmer. The power supply housing preferably comprises a switch bump 36 proximate to the switch 35. The bump 36 allows a user to feel by touch when the switch 35 has been moved to either the "on" or "off" position by the sliding switch's proximity to the switch bump 36. Alternately, the switch bump 36 can be lit to indicate when the power for the device is "on."

Figure 3:
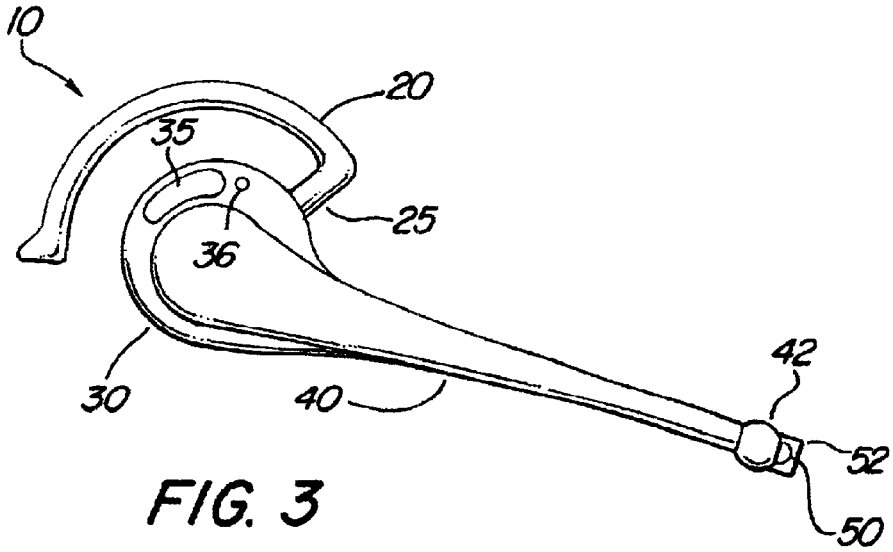
FIG. 3 is a side view of an alternate preferred embodiment of the invention.

FIG. 3 shows an alternate preferred embodiment of the invention 10. In particular, the distal end 42 of the lamp arm 40 is extended from the power supply housing 30 and angled downward. This configuration is preferably for use in reading or other activities where the user's eyes are aimed downward.

Figure 5:
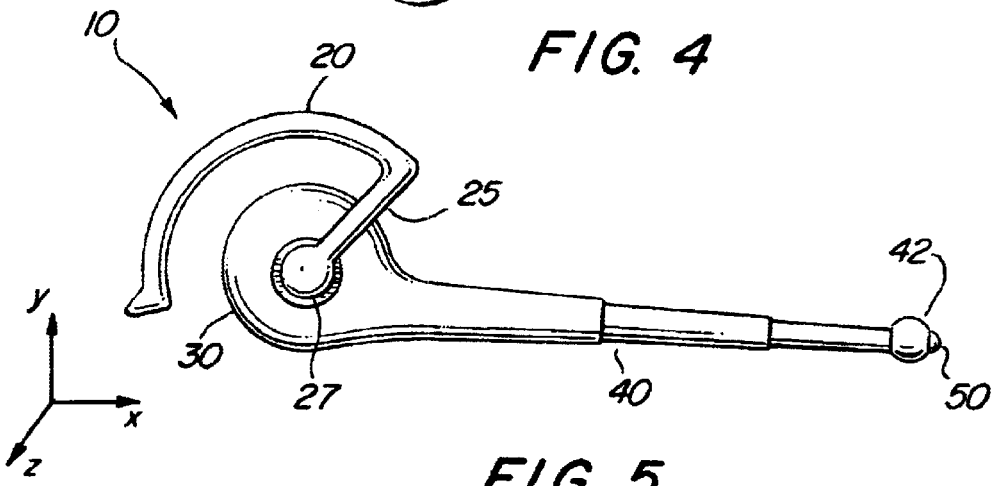
FIG. 5 is a reverse angle side view of another alternate embodiment of the invention.

FIG. 5 shows a reverse angle view of a preferred embodiment of the invention 10. As shown, the radial arm 25 is pivotally attached to the power supply housing 30. Preferably, the radial arm 25 is attached with a ball and socket configuration 27 that allows the power supply housing 30 to be pivoted in multiple axes, e.g. x-y, x-z. This can be used to position the light source 50 for improved viewing.

Alternately, the range of motion could be limited to only one axis (e.g. x-y) at a time. A further alternative allows the power supply housing 30, lamp arm 40 and light source 50 to be detached from the ear support 20. Again, this allows the user to reposition the light source 50 for improved viewing. Furthermore, as shown in FIG. 5, the lamp arm 40 is extendible, preferably using a telescoping segmented arm as shown. This feature can be used to improve positioning of the light source 50 and/or lamp arm 40. Alternatively, the lamp arm 40 can be bendable.

Thus, an improved earpiece light is described above that is not cumbersome, has a compact power source and is easy to position for viewing use. In each of the above embodiments, the different positions and structures of the present invention are described separately in each of the embodiments.

However, it is the full intention of the inventor of the present invention that the separate aspects of each embodiment described herein may be combined with the other embodiments described herein. Those skilled in the art will appreciate that adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An earpiece light for a user having an outer ear with a crest of helix and an external auditory canal; the earpiece light comprising:

an ear support for placement behind the crest of helix, attached to a power supply housing for placement over the external auditory canal;

said power supply housing having a power supply and a lamp arm with a distal end extended from the power supply housing; and, said power supply connected to a light source mounted on the distal end of the lamp arm.

2. The earpiece light of claim 1 where the lamp arm is pivotally attached to the power supply housing.

3. The earpiece light of claim 1 where the lamp arm is extendible.

4. The earpiece light of claim 1 where the power supply housing further comprises a dimmer control for the light source.

5. The earpiece light of claim 1 where the power supply housing further comprises a power switch for the light source.

6. An earpiece light comprising:

a power supply housing hanging from an ear support;

said power supply housing having a power supply and a lamp arm with a distal end, the lamp arm positioned below the ear support; and, said power supply connected to a light source mounted on the distal end of the lamp arm.

7. The earpiece light of claim 6 where the lamp arm is pivotally attached to the power supply housing.

8. The earpiece light of claim 6 where the lamp arm is extendible.

9. The earpiece light of claim 6 where the power supply housing further comprises a dimmer control for the light source.

10. The earpiece light of claim 6 where the power supply housing is pivotally connected to the ear support.

11. The earpiece light of claim 6 where the light source is a light emitting diode.

12. The earpiece light of claim 6 where the ear support is flexible.

13. The earpiece light of claim 6 where the power supply housing is detachable from the ear support.

14. The earpiece light of claim 6 where the lamp arm is flexible.

15. The earpiece light of claim 6 where the light source is a laser.

16. The earpiece light of claim 6 where a glare shield is mounted on the distal end of the lamp arm.

17. The earpiece light of claim 11 here the power supply housing further comprises an oscillating circuit connected to the light emitting diode for oscillating the light emitting diode.

18. The earpiece light of claim 6 where the power supply housing further comprises an adaptor jack to receive power from an alternate power supply.

19. The earpiece light of claim 18 where the power supply is a battery rechargeable via power received by the adaptor jack from the alternate power supply.

* * * * *